US005669134A

United States Patent [19]

Nogi et al.

[11] Patent Number: 5,669,134

[45] Date of Patent: *Sep. 23, 1997

[54] METHOD OF MANUFACTURING CHIP INDUCTOR

[75] Inventors: Kenichiro Nogi; Nobuhiro Umeyama, both of Tokyo, Japan

[73] Assignee: Taiyo Yuden Kabushiki Kaisha, Tokyo, Japan

[ * ] Notice: The term of this patent shall not extend beyond the expiration date of Pat. No. 5,544,410.

[21] Appl. No.: 525,420

[22] Filed: Sep. 7, 1995

[30] Foreign Application Priority Data

Sep. 9, 1994 [JP] Japan ..... 6-216224

[51] Int. Cl.[6] ..... H01F 41/02

[52] U.S. Cl. ..... 29/605; 29/608

[58] Field of Search ..... 29/605, 602.1, 29/606, 608; 336/83, 96; 264/272.17

[56] References Cited

U.S. PATENT DOCUMENTS 4,696,100 9/1987 Yamamoto et al. ..... 29/605

5,307,557 5/1994 Te-Hsueh ..... 29/605

5,544,410 8/1996 Kato et al. ..... 29/605

FOREIGN PATENT DOCUMENTS 58-48410 3/1983 Japan .

6-5427 1/1994 Japan .

*Primary Examiner*—Carl E. Hall

*Attorney, Agent, or Firm*—Armstrong, Westerman, Hattori, McLeland & Naughton

[57] ABSTRACT

A winding core is formed by extruding a kneaded material which is obtained by kneading a powdered magnetic material and a binder. A conducting wire is wound around the winding core in a coiled manner. An external cover element is formed by extruding the kneaded material to enclose the winding core, and the winding core and the external cover element are sintered. The semimanufactured product obtained by the above steps is cut into a predetermined length to thereby obtain a plurality of chip inductor main bodies. An external electrode is formed on each of end surfaces of the respective chip inductor main bodies such that the external electrode is connected to each of end portions of the conducting wire, the end portions being exposed to both end surfaces of the respective chip inductor main bodies.

3 Claims, 1 Drawing Sheet

METHOD OF MANUFACTURING CHIP INDUCTOR

BACKGROUND OF THE INVENTION

1. Field of the Invention

The present invention relates to a method of manufacturing a chip inductor which uses a sintered magnetic core.

2. Description of Related Art

Conventionally, there is known a method of manufacturing a chip inductor, characterized in that: a kneaded material to be obtained by kneading a powdered magnetic material (or magnetic substance) and a binder is pressurized to form it into a rectangular parallelepiped or a cylindrical body and thereafter sinter it to manufacture a bar of the magnetic material; a conductor (or a conducting wire) is wound around the bar of the magnetic material to thereby mount a coil in a coiled manner; the coil is then covered with the kneaded material of the powdered magnetic material and the binder to thereby apply an external cover (or coating); and thereafter a semimanufactured product thus obtained is sintered.

In the above-described chip inductor, the coil is covered with the magnetic material. Therefore, a circular magnetic circuit is formed in a manner to enclose the coil, with the result that an inductance value is high and that there is little or no magnetic field to leak outside the magnetic material. It has consequently an advantage in that, even if the chip inductor is disposed in close proximity to other parts, there will be exerted no influence on the characteristics as an inductor and therefore that a density of mounting parts on a wiring circuit board, or the like, can be made higher.

However, this method of manufacturing inductors has disadvantages in that it is not suitable for mass production and that, due to the shrinkage of the kneaded material of the external cover during the sintering, there is applied a pressure to the bar of the magnetic material inside the coil via the conducting wire of the coil and/or via a clearance between adjoining windings of the conducting wire. As a result, a bad effect on magnetic characteristics and a deterioration in impedance characteristics is created.

SUMMARY OF THE INVENTION

The present invention has an object of providing a method of manufacturing a chip inductor which is free from above-described disadvantages, is suitable for mass production, and is superior in the impedance characteristics.

In order to attain the above and other objects, the present invention provides a method of manufacturing a chip inductor comprising the steps of: forming a winding core by extruding a kneaded material which is obtained by kneading a powdered magnetic material and a binder; winding a conducting wire around the winding core in a coiled manner; forming an external cover element to enclose the winding core around which the conducting wire has been wound, the external cover element being formed by extruding the kneaded material; sintering the winding core and the external cover element; cutting a semimanufactured product obtained by the preceding steps into a predetermined length to thereby obtain a plurality of chip inductor main bodies; and forming an external electrode on each of the surfaces of the respective chip inductor main bodies such that the external electrode is connected to each of the portions of the conducting wire, the end portions being exposed to both end surfaces of the respective chip inductor main bodies.

Preferably, a mixing ratio of the powdered magnetic material and the binder for the winding core is selected to be smaller than, or equal to, a mixing ratio of the powdered magnetic material and the binder for the external cover element such that a shrinkage percentage, at the time of sintering, of the winding core is greater than, or equal to, a shrinkage percentage, at the time of sintering, of the external cover element.

Further, preferably, a particle size of the powdered magnetic material for the winding core is made to be smaller than, or equal to, a particle size of the powdered magnetic material for the external cover element such that the shrinkage percentage, at the time of sintering, of the winding core becomes larger than, or equal to, the shrinkage percentage, at the time of sintering, of the external cover element.

A plurality of chip inductor main bodies can be manufactured at the same time by the following steps of forming a winding core by extruding the kneaded material to be obtained by kneading the powdered magnetic material and the binder; winding the conducting wire around the winding core in a coiled manner; forming an external cover element to enclose the winding core around which the conducting wire has been wound, the external cover element being formed by extruding the kneaded material; sintering the winding core and the cover element; and cutting the semimanufactured product obtained by the preceding steps into a predetermined length to thereby obtain a plurality of chip inductor main bodies.

If the mixing ratio of the powdered magnetic material and the binder for the winding core is selected to be smaller than, or equal to, the mixing ratio of the powdered magnetic material and the binder for the external cover element such that the shrinkage percentage, at the time of sintering, of the winding core becomes larger than, or equal to, the shrinkage percentage, at the time of sintering, of the external cover element, or if the particle size of the powdered magnetic material for the winding core is made to be smaller than, or equal to, the particle size of the powdered magnetic material for the external cover element such that the shrinkage percentage, at the time of sintering, of the winding core becomes larger than, or equal to, the shrinkage percentage, at the time of sintering, of the external cover element, a stress due to shrinking of the external cover element at the time of sintering is not generated on the winding core via the conducting wire and/or via the clearance between the adjoining winds of the conducting wire. Therefore, the impedance characteristics of the inductor will not be impaired.

BRIEF DESCRIPTION OF THE DRAWINGS

The above and other objects and the attendant advantages of the present invention will become readily apparent by reference to the following detailed description when considered in conjunction with the accompanied drawings wherein.

DETAILED DESCRIPTION OF PREFERRED EMBODIMENTS

An explanation will now be made about an embodying example of the present invention with reference to the accompanying drawings.

Figure 1:
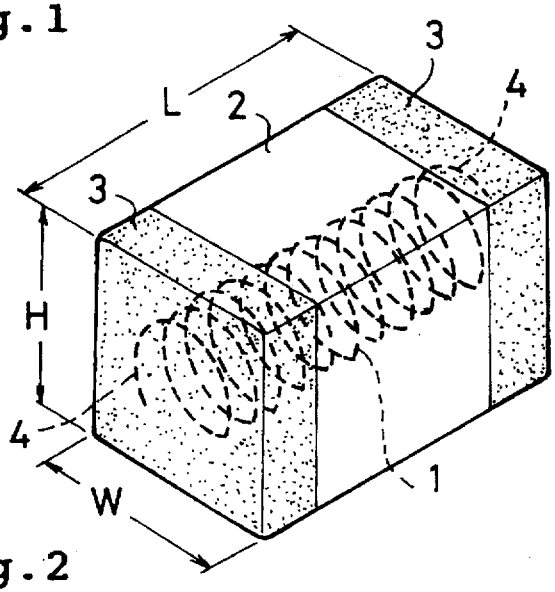
FIG. 1 is a perspective view of a chip inductor manufactured by the method of manufacturing according to the present invention.

FIG. 1 represents a chip inductor manufactured by the method of the present invention.

In the figure, reference numeral 1 denotes a conductor in a coiled manner (or a coiled conducting wire) formed by winding a conducting wire made of a silver wire of 20–100 μm in diameter. Reference numeral 2 denotes a magnetic member having the shape of a rectangular parallelepiped in which was embedded the coiled conducting wire 1 and which was made, e.g., of ferrite (e.g., L=1.0–10.0 mm, W=0.5–10.0 mm, H=0.5–10.0 mm, e=0–4.0 mm). Reference numerals 3, 3 denote external electrodes made by coating both end surfaces of the magnetic member 2. The external electrodes 3, 3 are connected to both end portions 4, 4 of the coiled conducting wire 1 which were exposed to both the end surfaces. These external electrodes 3, 3 were made, for example, of silver electrodes and were subjected to nickel plating or lead-tin plating on top thereof.

The above-described magnetic member 2 was made up of an internal magnetic element which serves as a winding core around which the coiled conducting wire 1 is wound and a magnetic element which serves as an external cover element to cover or coat the coiled conducting wire 1. The internal magnetic element was made of a ferrite whose composition is iron, nickel, zinc, copper, or the like. This ferrite was manufactured by forming a kneaded material of columnar shape with a kneaded material of a powdered magnetic material (or raw meal of a magnetic material) of 0.7 μm in particle size and a binder of glycerin-methyl cellulose, both being mixed in the ratio of 100:8, and thereafter sintering the kneaded material. After sintering, it had a permeability of 100, and a shrinkage percentage at the time of sintering was 23%, for example. This shrinkage at the time of sintering is also called a firing shrinkage and the shrinkage percentage is represented by the formula $\{(l_0-l_1)/l_0\}\times 100$, where $l_0$ is the length of the formed semimanufactured product before sintering and $l_1$ is the length after sintering it. The magnetic element which serves as the external cover element was made up of the powdered magnetic material of the same composition and particle size as those of the above-described internal magnetic element, and the same binder. To make the external cover element, the kneaded material having the powdered magnetic material and the binder in a mixing ratio of 100:6 was sintered, and the shrinkage percentage thereof at the time of sintering was 20%, for example. With these shrinkage percentages, the parallelepiped (i.e., the external cover element) of 4.0 mm in height (H) and also 4.0 mm in width (W) became, after sintering, both 3.2 mm. The winding core, on the other hand, of 2.6 mm in diameter inside the coiled conducting wire 1 became 2.0 mm after sintering. An internal diameter of the external cover element became 2.08 mm after sintering. It follows that a clearance of 0.08 mm was formed between the internal diameter of the external cover element in which the coiled conducting wire 1 was contained and the diameter of the magnetic element as the winding core.

Next, an explanation will now be made about the method of manufacturing the chip inductor of the present invention as shown in FIG. 1.

Figure 2:
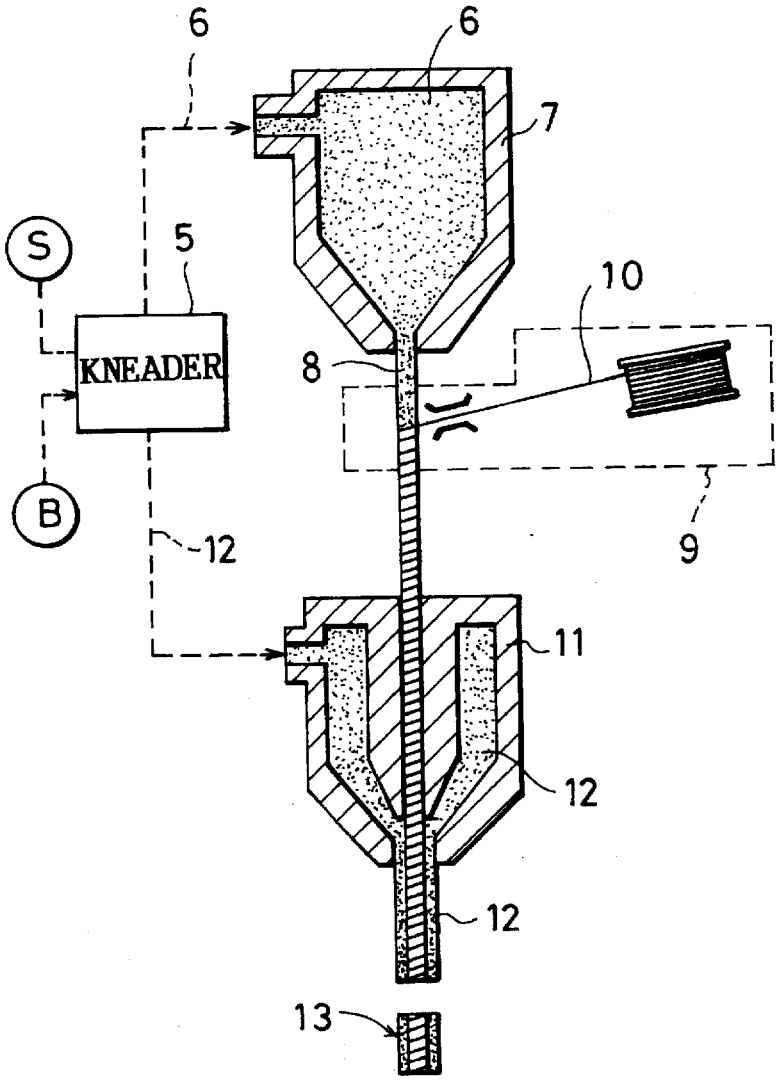
FIG. 2 is an explanation diagram showing an apparatus to be used in carrying out the method of manufacturing of the chip inductor of the present invention.

As shown in FIG. 2, the binder S and the powdered magnetic material B of the above-described mixing ratio were kneaded by a kneader 5 to homogenize the powdered magnetic material and the binder. The kneaded material 6 was fed under pressure to a primary extruder 7. A molded bar-like body 8, serving as a winding core, which was molded to a desired diameter of 0.5–10 mm, for example, was extruded out of an outlet of the primary extruder 7 at a speed of 30 m/min, for example. This bar-like body 8 was dried in a dryer (not shown). Thereafter, a conducting wire 10 was wound by a winding device 9 around the bar-like body 8. The bar-like body 8 having wound therearound the conducting wire 10 was fed to a secondary extruder 11. To this secondary extruder 11 there was fed in advance under pressure a kneaded material 12 which was made by increasing the mixing ratio of the powdered magnetic material and the binder as compared with the mixing ratio of the kneaded material 6 that was fed under pressure to the primary extruder 7 so that the shrinkage percentage of the kneaded material 12 becomes smaller than that of the kneaded material 6. Therefore, by this secondary extruder 11 the conducting wire 10 wound around the bar-like body 8 was coated or covered by the kneaded material 12, thereby forming an external cover element (or a coating element). Thereafter, the semimanufactured product obtained by the preceding steps was cut into a size to suit the size of a sintering furnace or the shape of a setting device on which the semimanufactured product is placed for sintering in the sintering furnace. The semimanufactured product was then sintered at 600°–1000° C., in particular at 900° C., and was cut by a cutting device to suit the dimensions of respective inductors. The individual cut inductor main bodies 13 were then subjected to barrel polishing using a barreling powder and water and were rounded at corner portions thereof. Thereafter, a silver paste was coated on both external surface portions and adjoining peripheral external portions of each inductor main body 13, and was baked to thereby form external electrodes 3, 3. At this time, end portions 4, 4 of the conducting wire 10 and the external electrodes 3, 3 were connected to each other. To the silver layer of each external electrode 3 there was applied a nickel plating and a solder plating.

In this embodying example, the shrinkage percentage, at the time of sintering, of the magnetic element inside the coiled conducting wire 1 was made larger than the shrinkage percentage of the magnetic element in the form of the external cover element. Therefore, the stress of the magnetic element in the form of the external cover element due to shrinkage thereof at the time of sintering is not exerted on the magnetic element inside the coiled conducting wire 1 via the coiled conducting wire 1 and/or the clearance between the adjoining winds of the coiled conducting wire 1. The impedance characteristics of the inductor will consequently not be deteriorated.

In this embodying example, the mixing ratio of the powdered magnetic material and the binder in the winding core was changed from that of the external cover element. However, if the mixing ratio for the winding core is made equal to that for the external cover element so as to give them the same shrinkage percentage, the stress due to shrinking of the external cover element at the time of sintering is not imposed on the winding core. Furthermore, since there occurs no clearance between the coiled conducting wire and the winding core, the impedance characteristics are further improved.

The particle size of the powdered magnetic material for the above-described winding core may be made to be 0.7

μm, for example, and the particle size of the powdered magnetic material for the above-described external cover element may be made, for example, to be coarser than 0.7 μm or equal thereto, with the remaining conditions being the same. It may thus be arranged that the shrinkage percentage of the winding core at the time of sintering becomes larger than, or equal to, the shrinkage percentage of the external cover element.

As described hereinabove, since the present invention has the above-described arrangement, it has advantages in that it is suitable for mass production and that the chip inductor which is superior in impedance characteristics can be obtained.

It is readily apparent that the above-described method of manufacturing a chip inductor meets all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A method of manufacturing a chip inductor comprising the steps of:

continuously molding a winding core by continuously extruding a kneaded material which is a mixture of powdered magnetic material and a binder;

continuously winding a conducting wire around said molded winding core in a coiled manner;

continuously molding an external cover element by continuously extruding said kneaded material to enclose said molded winding core around which said conducting wire has been wound;

thereafter, sintering said molded winding core with the conducting wire wound thereon and said molded external cover element enclosing said conducting wire and said core;

cutting a semimanufactured product obtained by the preceding steps into a predetermined length to thereby obtain a plurality of chip inductor main bodies; and installing an external electrode on each end surface of said respective chip inductor main bodies such that said external electrode is connected to each end portion of said conducting wire, said end portions being exposed at opposite ends of said respective chip inductor main bodies.

2. A method of manufacturing a chip inductor according to claim 1, wherein a mixing ratio of said powdered magnetic material and said binder for molding said winding core is selected to be smaller than, or equal to, a mixing ratio of said powdered magnetic material and said binder for molding said external cover element such that a shrinkage percentage, at the time of sintering, of said winding core becomes larger than, or equal to, a shrinkage percentage at the time of sintering of said external cover element.

3. A method of manufacturing a chip inductor according to claim 1, wherein a particle size of said powdered magnetic material used in said mixture for molding said winding core is made to be smaller than, or equal to, a particle size of said powdered magnetic material used in said mixture for molding said external cover element such that a shrinkage percentage at the time of sintering of said winding core becomes larger than, or equal to, a shrinkage percentage at the time of sintering of said external cover element.

* * * * *